United States Patent [19]

Corbett

[11] Patent Number: 4,802,447

[45] Date of Patent: Feb. 7, 1989

[54] FOAM PATTERN FOR ENGINE CYLINDER BLOCK

[75] Inventor: William D. Corbett, Fond du Lac, Wis.

[73] Assignee: Brunswick Corporation, Skokie, Ill.

[21] Appl. No.: 809,987

[22] Filed: Dec. 17, 1985

[51] Int. Cl.[4] ..... B22C 7/02

[52] U.S. Cl. ..... 123/65 K; 123/73 PP; 164/45; 164/235

[58] Field of Search ..... 123/73 A, 73 PP, 193 CH, 123/195 R, DIG. 1, DIG. 6, DIG. 7, 65 R, 59 B; 164/34, 35, 36, 45, 235, 246, 249

[56] References Cited

U.S. PATENT DOCUMENTS

| | | | |
|---|---|---|---|
| 882,401 | 3/1908 | Melhuish . | |
| 1,087,492 | 2/1914 | Hiehle . | |
| 1,874,446 | 8/1932 | Chilton . | |
| 2,406,404 | 8/1946 | Ryde | 123/73 |
| 2,491,630 | 12/1949 | Voorhies | 121/194 |
| 3,160,149 | 12/1964 | Kamm | 123/65 |
| 3,459,253 | 8/1969 | Woolcott | 164/36 |
| 3,695,239 | 10/1972 | Papst | 123/65 PD |
| 3,858,562 | 1/1975 | Lanpheer | 123/73 A |
| 3,938,481 | 2/1976 | Morton | 123/69 R |
| 4,026,254 | 5/1977 | Ehrlich | 123/73 AA |
| 4,093,018 | 6/1978 | Trumbauer | 164/32 |
| 4,176,650 | 12/1979 | Noguchi et al. | 123/198 F |
| 4,190,093 | 2/1980 | Kearney | 164/34 |
| 4,197,899 | 4/1980 | Ernest | 164/34 |
| 4,204,488 | 5/1980 | Onishi | 123/73 A |
| 4,252,175 | 2/1981 | Whipple | 164/9 |
| 4,261,306 | 4/1981 | Gorr | 123/73 A |
| 4,287,860 | 9/1981 | Fujikawa et al. | 123/73 A |
| 4,312,304 | 1/1982 | Tyner | 123/73 A |
| 4,328,770 | 5/1982 | Hale | 123/59 B |
| 4,373,475 | 2/1983 | Kirk | 123/73 A |
| 4,462,453 | 7/1984 | Trumbauer | 164/32 |
| 4,559,908 | 12/1985 | Flaig et al. | 123/195 R |
| 4,592,311 | 6/1986 | Makino | 123/73 A |
| 4,632,169 | 12/1986 | Osborn et al. | 164/45 |
| 4,653,161 | 3/1987 | Sanchez | 29/156.4 R |

FOREIGN PATENT DOCUMENTS

| | | |
|---|---|---|
| 2479904 | 10/1981 | France . |
| 52-97908 | 7/1977 | Japan . |

*Primary Examiner*—David A. Okonsky

*Attorney, Agent, or Firm*—Andrus, Sceales, Starke & Sawall

[57] ABSTRACT

A polystyrene foam pattern (10) is provided for the cylinder block of a crankcase compression two-cycle engine having transfer passages (15) formed in the block. The pattern includes a head-end component (12) and a crankcase end component (11) mating with each other. The mating surfaces extend through the transfer ports (14), transfer passages (15), and exhaust ports (16) to allow the formation of complex passages with die cast pattern components.

3 Claims, 4 Drawing Sheets

FOAM PATTERN FOR ENGINE CYLINDER BLOCK

TECHNICAL FIELD

This invention relates to patterns for casting the cylinder block of internal combustion engines and particularly to a foam pattern for use with the lost foam casting process.

BACKGROUND ART

Cylinder blocks of two cycle crankcase compression engines are now commonly formed by die casting. For economic reasons, however, it has become desirable to form engine blocks by the lost foam process. Such a process allows the manufacturer to form a more complex cylinder block by first casting the foam pattern in several parts, then gluing the pattern parts together, to form the more complex pattern. The resulting cylinder block cast by such a pattern can have a more complex shape than could be achieved using the more conventional die casting process. Commonly, foam patterns duplicate the patterns for pre-existing components such as cylinder blocks, water jacket covers, and exhaust manifolds. The foam pattern components can then be glued together to eliminate machining and assembly operations which would have been required by the prior die casting processes. The foam pattern components are typically formed by die casting, so that it is a natural step to provide foam pattern components in a form similar to that used for the die cast aluminum components. An example of one such prior die cast engine block using multiple components to ahieve the desirable flow passage shapes is shown in U.S. Pat. No. 4,328,770 to Hale.

DISCLOSURE OF INVENTION

The present invention provides a pattern for the cylinder block of a crankcase compression two cycle engine. The cylinder block has a transfer passage extending through the cylinder block to connect the crancase end of a cylinder with a transfer port in the wall of the cylinder. The transfer port is positioned intermediate the crankcase and head ends of the cylinder. The cylinder block also includes an exhaust port through the wall of the cylinder intermediate the ends of the cylinder. The pattern includes a first die cast pattern component for the head end of the cylinder block. The first component includes a first cylinder cavity defining the head end of the cylinder and the head ends of the transfer port and transfer passage. The first cylinder cavity is formed free of projections which would prevent withdrawal of a forming die in a direction parallel to the axis of the cylinder. A second die cast pattern component for the crankcase end of the cylinder block includes a transfer cavity defining the crankcase ends of the transfer port and transfer passage. Like the first cylinder cavity, the transfer cavity is also formed free of projections which would prevent the withdrawal of a forming die in a direction parallel to the axis of the cylinder. Finally, the pattern includes means to join the first and second components together.

Preferably the second pattern component also includes a second cylinder cavity defining the crankcase end of the cylinder.

It is desirable to provide one of the components with a projection extending parallel to the cylinder and the other component with a cavity for receiving the projection to assure proper alignment of the first and second components on assembly. Preferably the projection is cylindrical and coaxial with the cylinder.

In the preferred embodiment the crankcase end of the exhaust port is formed on the second component, particularly on the cylindrical projection which extends into the mating cavity in the first component. The second component can be provied with a plurality of projections extending parallel to the cylinder to mate with a corresponding plurality of cavities formed in the first component.

The pattern can include a plurality of transfer passages spaced circumferentially around the cylinder with each of the passages connecting the crankcase end of the cylinder with a transfer port formed at an intermediate portion of the cylinder wall. The first cylinder cavity would then define the head ends of the transfer ports and transfer passages and the second pattern component would include a plurality of transfer cavities defining the crankcase ends of the transfer ports and transfer passages. Again each of the cavities would be free of projections which would prevent the withdrawal of a forming die in a direction parallel to the axis of the cylinder.

Such a pattern allows the formation of very complex transfer passages and transfer ports. Further, the invention allows the formation of a pattern having an improved crankshaft bearing structure, since the forming die for the transfer passages does not have to be withdrawn through the crankcase end of the second pattern component.

BRIEF DESCRIPTION OF DRAWINGS

FIG. 6 is a partially exploded, partial sectional view taken along lines 6—6 of FIGS. 2 and 3.

BEST MODE FOR CARRYING OUT THE INVENTION

Figure 1:
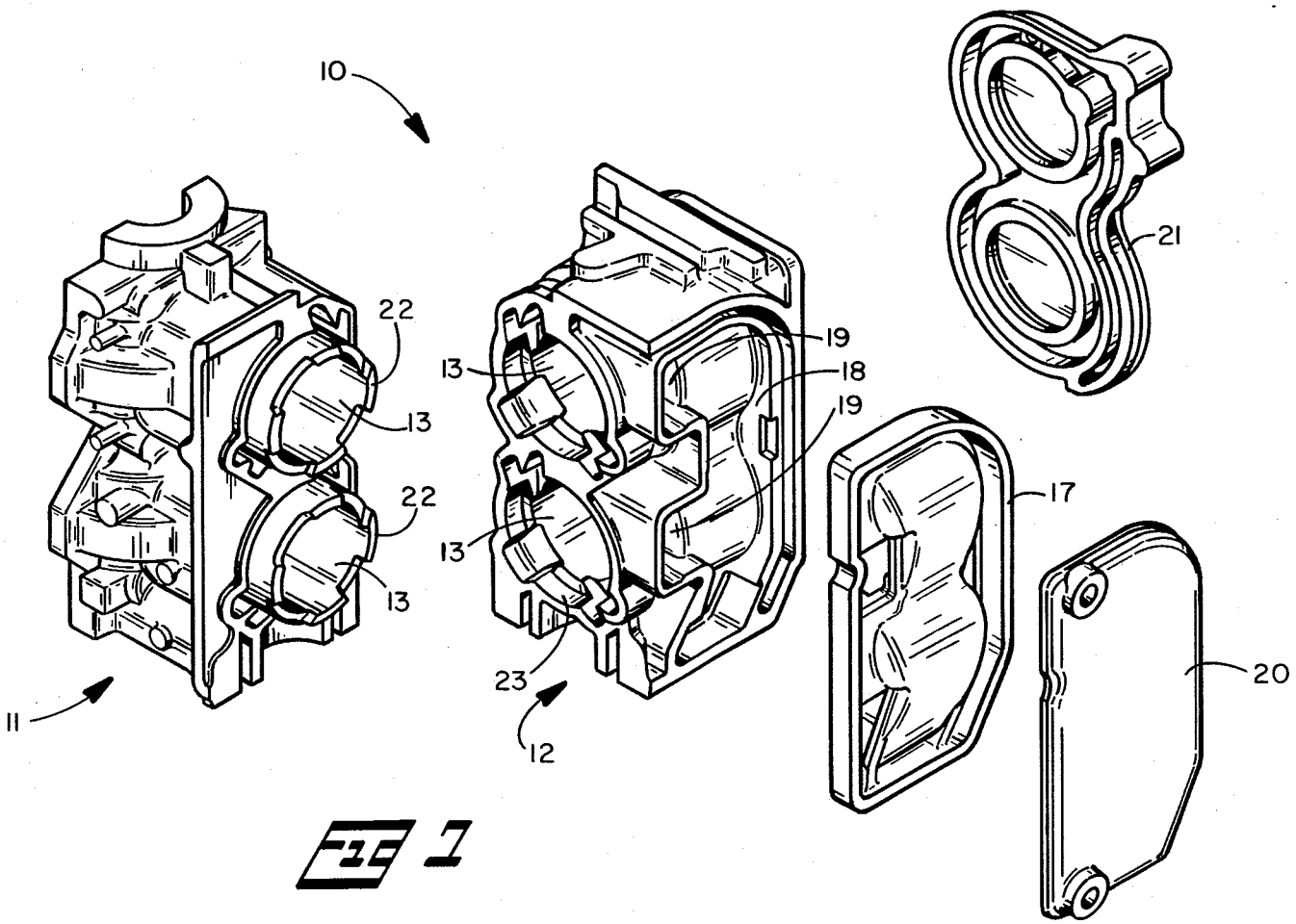
FIG. 1 is an exploded view of a pattern for an engine cylinder block in accordance with the invention.
Figure 3:
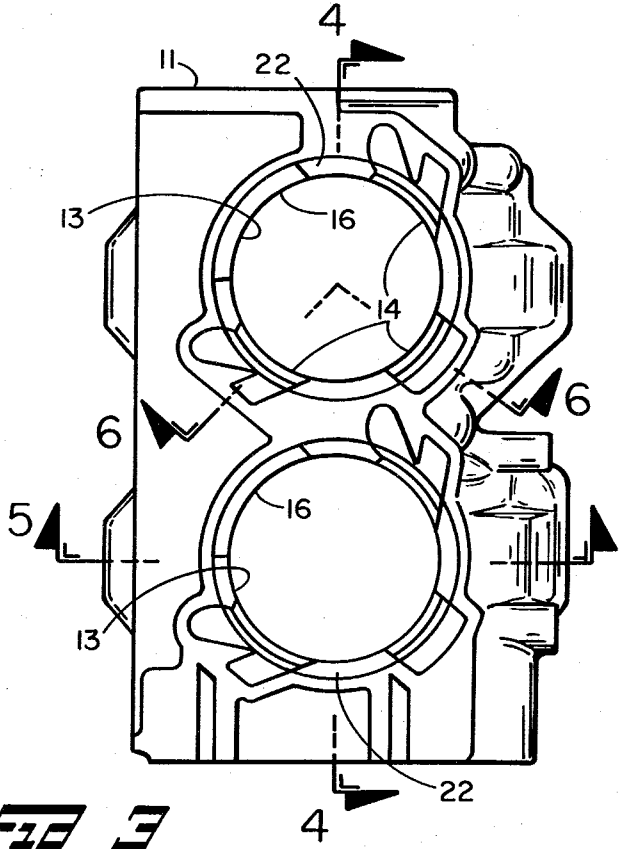
FIG. 3 is a view of the crankcase end component of the cylinder block pattern.
Figure 2:
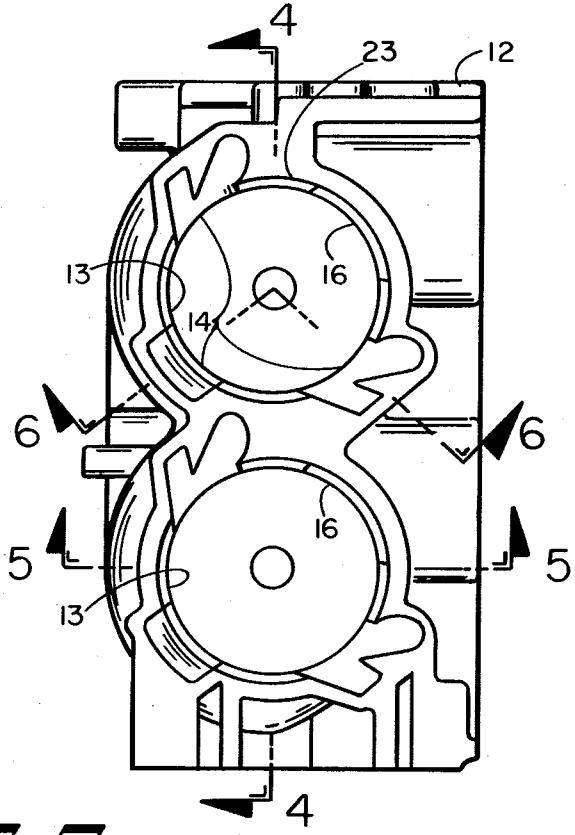
FIG. 2 is a view of the mating surface of the head end component of the cylinder block pattern.
Figure 5:
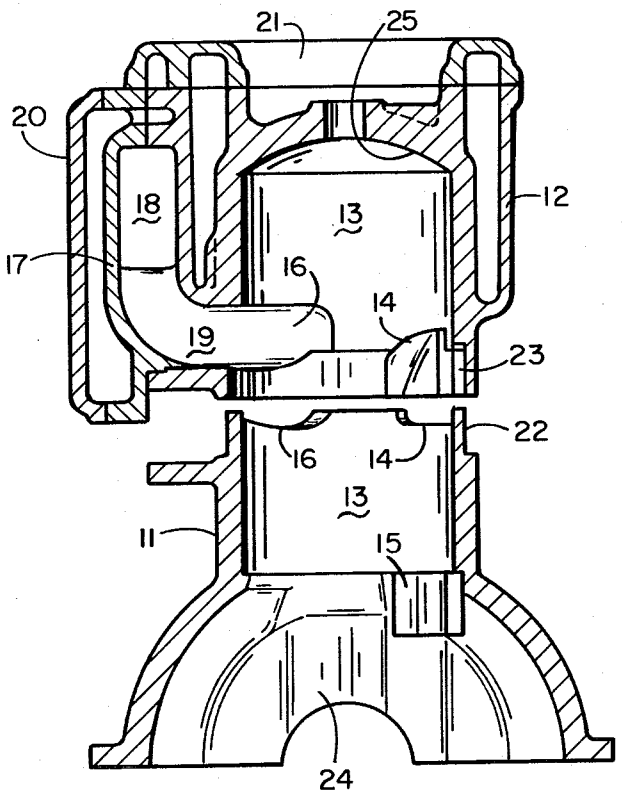
FIG. 5 is a partially exploded sectional view taken along lines 5—5 of FIGS. 2 and 3.
Figure 4:
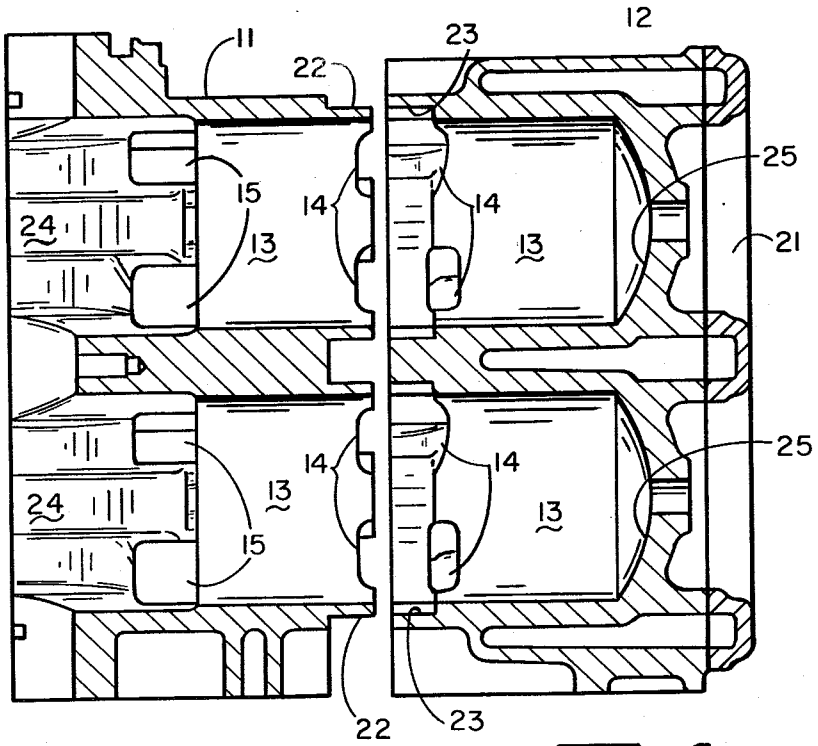
FIG. 4 is a partially exploded sectional view taken along lines 4—4 of FIGS. 2 and 3.

Turning now to the Figures, FIG. 1 shows the foam components of a cylinder block pattern 10 in accord with the invention in exploded relationship. The crankcase end component 11 of the cylinder block pattern 10 mates with the head end component 12 of the cylinder block pattern 10 to define the cylinders 13, transfer ports 14, transfer passages 15 and exhaust ports 16. An exhaust manifold cover pattern component 17 attaches to the head end component 12 to complete an exhaust manifold 18 formed on the side of the engine and define exhaust passages 19 connected to the exhaust ports 16. An exhaust manifold water jacket cover pattern component 20 attaches over the manifold cover component 17 to complete a water jacket over the exhaust manifold 18. A cylinder head water jacket pattern component 21 attaches to the head end of the head end component 12 of the cylinder block to complete a water jacket for the head ends of the two engine cylinders 13. The five pattern components 11, 12, 17, 20 and 21 are glued together in a known manner to form a completed pattern 10 for the cylinder block. Each of the pattern components is formed by die casting of polystyrene foam to facilitate rapid and inexpensive manufacture of the pattern components.

The pattern is intended for use in forming an aluminum cylinder block by the lost foam method of casting. In this method, a mold for the cylinder block is formed by filling around the foam pattern with casting sand. The cylinder block is then formed by pouring molten aluminum into the pattern. The polystyrene foam pattern is vaporized by the molten aluminum during the pouring to allow the aluminum to fill the mold.

The engine block formed by the pattern 10 will include two cylnders 13 with three transfer passages 15 formed in the block around each cylinder 13 to communicate between the crankcase and the head end of the cylinders 13. The transfer passages 15 are arranged to provide a flow pattern in the cylinders 13 effective to direct a fuel air charge into the cylinders through the transfer ports 14 and effectively scavenge combustion products from the cylinders 13 and direct them out the exhaust ports 16. From the exhaust ports 16 the exhaust gas flows through the exhaust passages 19 defned by the exhaust manifold cover pattern component 17 and head end of the cylinder block. As is well known in the art, the shape and direction of the transfer passages will have a substantial effect on the engine's performance.

The cylinder block pattern components 11 and 12 are particularly structured to allow the forming of the complex transfer ports 14, transfer passages 15, and exhaust ports 16 for a two cycle engine. To permit the formation of complex shaped transfer ports 14 and exhaust ports 16, the crankcase end component 11 and the head end component 12 are divided through the transfer ports 14 and exhaust ports 16. Cylindrical extensions 22 are formed on the crankcase component 11 coaxial with and surrounding the ends of the cylinders 13. The cylindrical extensions 22 mate with correspondig cylindrical cavities 23 in the head end component 12. The portions of the three transfer ports 14 and the exhaust port 16 nearest the crankcase 24 are formed on these cylindrical extensions 22. This arrangement allows the formation of chamfers 24 adjacent the ports 14 to effect a desirable flow direction through the transfer ports 14. The ports 14 and 16 as well as the portions of the associated transfer passages 15 formed in the crankcase end component 11 are formed by a forming die which is withdrawn along an axis parallel to the axes of the cylinders 13 and in a direction toward the cylinder heads 25. This allows the die to also form the ends of the transfer passages 15 adjacent the crankcase 24. The walls of the cylinders 13 and crankcase 24 in the crankcase component 11 are formed by another die which is withdrawn parallel to the axes of the cylinders 13 and in a direction away from the cylinder heads 25.

The portions of the engine's cylinders 13 formed in the head end pattern component 12 are formed by a forming die withdrawn in a direction parallel to the axes of the cylinders 13 and in a direction toward the crankcase 24. The cylinder cavities thus formed define the internal cylinder heads 25 and cylinders 13 as well as the head end portions of the transfer passages 15 and ports 14. A substantial portion of the head ends of the transfer passages 15 is formed in that portion of the head end component 12 that surrounds and mates with the cylindrical extensions 22 of the crankcase end component 11. Thus very complex transfer passages 15 are shaped to provide the most desirable flow patterns.

Figure 7:
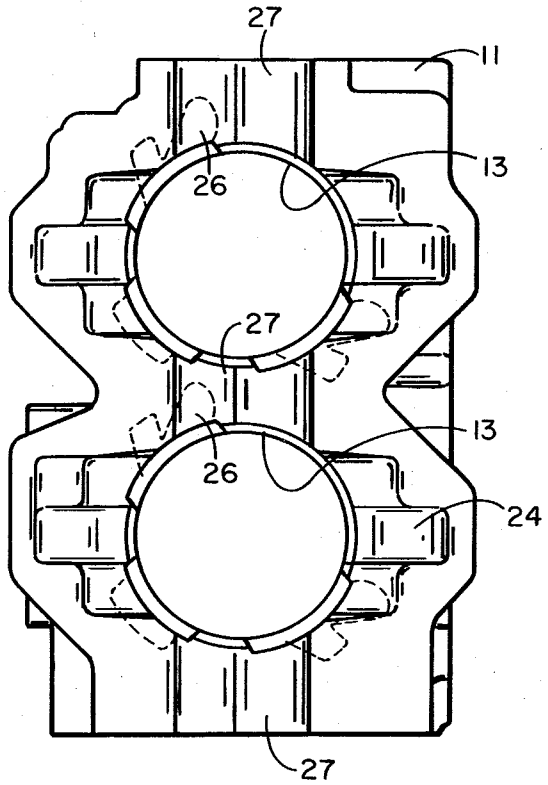
FIG. 7 is a view of the crankcase end of the crankcase end component of the cylinder block pattern.
Figure 9:
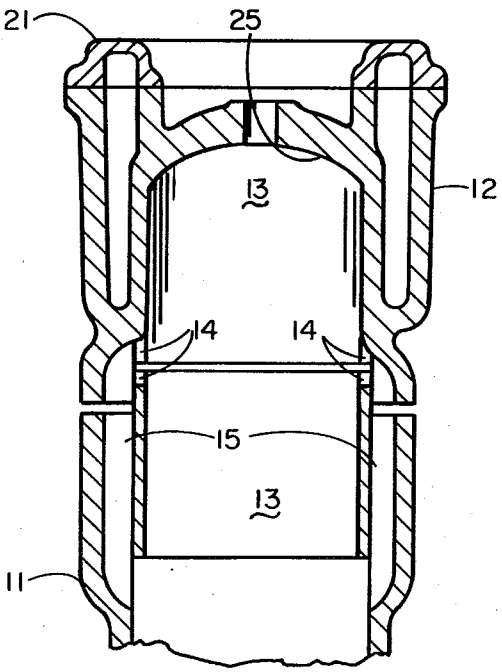

The foregoing arrangement allows the formation of the three transfer passages 15 and transfer ports 14 with the use of just two pattern components, the crankcase end component 11 and the head end component 12. As shown most clearly in FIG. 7, the division of that portion of the cylinder block forming the cylindrs 13 into just two components 11 and 12, with the division surface between the components extending through the ports 14 and 16, allows the formation of the head ends of the transfer passages 15 without the necessity of withdrawing the forming die through the crankcase end of the cylinder block. If the head ends of the transfer passages 15 were formed by withdrawing through the crankcase end of the cylinder block, the die would have to be withdrawn through the areas 26 indicated by the broken lines in FIG. 7. This would necessarily remove portions of the crankshaft bearing areas 27.

I claim:

1. A foam pattern for use in a lost foam casting process for making a cylinder block of a crankcase compression, two-cycle engine, said cylinder block having a transfer passage extending through the cylinder block to connect a crankcase end of a cylinder with a transfer port in a wall of the cylinder, said transfer port positioned intermediate the crankcase and head ends of the cylinder, and having an exhaust port through the wall of the cylinder intermediate the ends of the cylinder, said pattern comprising:

(A) a first die cast pattern component for a head end of the cylinder block, said first component including a first cylinder cavity defining the head end of said cyinder and head ends of said transfer port and transfer passage, said first cylinder cavity being free of projections which would prevent the withdrawal of a forming die in a direction parallel to the axis of said cylinder;

(B) a second die cast pattern component for the crankcase end of the cylinder block, said second component including a transfer cavity defining crankcase ends of said transfer port and transfer passage, said transfer cavity being free of projections which would prevent the withdrawal of a forming die in a direction parallel to the axis of said cylinder; and (C) a means to join said first and second components together, wherein said second component further includes a second cylinder cavity defining a crankcase end of said cylinder, wherein said second pattern component includes a cylindrical projection coaxial with and encircling a portion of said cylinder and said first pattern component includes a cylindrical cavity mating with said cylindrical projection, wherein the crankcase end of said transfer port is defined at the end of said cylindrical projection.

2. The pattern defined in claim 1 wherein a portion of the head end of said transfer passage is defined in the wall of said mating cylindrical cavity.

3. A pattern for a cylinder block of a crankcase compression, two-cycle engine, said cylinder block having a transfer passage extending through the cylinder block to connect a crankcase end of a cylinder with a transfer port in a wall of the cylinder, said transfer port positioned intermediate the crankcase and head ends of the cylinder, and having an exhaust port through the wall of the cylinder intermediate the ends of the cylinder, said pattern comprising:

(A) a first die cast pattern component for a head end of the cylinder block, said first component including a first cylinder cavity defining the head end of said cylinder and head ends of said transfer port and transfer passage, said first cylinder cavity being free of projections which would prevent the withdrawal of a forming die in a direction parallel to the axis of said cylinder;

(B) a second die cast pattern component for the crankcase end of the cylinder block, said second component including a transfer cavity defining crankcase ends of said transfer port and transfer passage, said transfer cavity being free of projections which would prevent the withdrawal of a forming die in a direction parallel to the axis of said cylinder, a second cylinder cavity defining the crankcase end of said cylinder, a projection extending parallel to said cylinder and said first component includes a cavity for receiving said projection, and wherein a crankcase end of said exhaust port is formed on said projection; and (C) a means to join said first and second components together.

* * * * *